US009486972B2

(12) United States Patent
Mack et al.

(10) Patent No.: US 9,486,972 B2
(45) Date of Patent: Nov. 8, 2016

(54) BULK BIN FORMER APPARATUS AND METHOD

(75) Inventors: Michael A. Mack, Delta (CA); Jindai Huang, Surrey (CA)

(73) Assignee: Wexxar Packaging, Inc., Delta (CA)

( * ) Notice: Subject to any disclaimer, the term of this patent is extended or adjusted under 35 U.S.C. 154(b) by 755 days.

(21) Appl. No.: 13/612,172

(22) Filed: Sep. 12, 2012

(65) Prior Publication Data

US 2014/0073497 A1 Mar. 13, 2014

(51) Int. Cl.

| | |
|---|---|
| ***B31B 1/62*** | (2006.01) |
| ***B31B 1/00*** | (2006.01) |
| ***B65D 5/12*** | (2006.01) |

(52) U.S. Cl.

CPC . *B31B 1/00* (2013.01); *B65D 5/12* (2013.01); *B31B 2217/066* (2013.01)

(58) Field of Classification Search

None

See application file for complete search history.

(56) References Cited

U.S. PATENT DOCUMENTS

| | | | | | |
|---|---|---|---|---|---|
| 1,894,209 | A | | 7/1929 | Wikstrom | |
| 2,139,626 | A | * | 12/1938 | Sidebotham | B31B 17/00 229/122.3 |
| 2,244,282 | A | * | 6/1941 | Bergstein | B31B 17/00 156/461 |
| 2,292,403 | A | * | 8/1942 | Peters | B31B 3/00 493/151 |
| 2,697,313 | A | * | 12/1954 | Wilcox | B31B 1/32 141/11 |
| 2,704,179 | A | * | 3/1955 | Wilcox | B65D 5/12 229/125.19 |
| 3,913,300 | A | * | 10/1975 | Benzing | B65B 7/2871 493/169 |
| 4,798,571 | A | * | 1/1989 | Everman | B31B 1/00 493/114 |
| 5,147,271 | A | | 9/1992 | Bacques et al. | |
| 5,531,661 | A | * | 7/1996 | Moncrief | B65B 43/265 493/313 |
| 5,624,368 | A | | 4/1997 | Cromwell | |
| 5,656,006 | A | | 8/1997 | East et al. | |
| 6,106,450 | A | * | 8/2000 | Brittain | B31B 1/76 493/171 |
| 7,381,176 | B2 | | 6/2008 | Graham et al. | |
| 7,510,516 | B2 | | 3/2009 | Zetterstrom et al. | |
| 7,681,781 | B2 | | 3/2010 | Wisecarver | |
| 7,682,300 | B2 | * | 3/2010 | Graham | B31B 1/90 493/123 |
| 8,075,467 | B2 | * | 12/2011 | Monti | B31B 1/80 493/177 |
| 8,128,547 | B2 | | 3/2012 | Graham et al. | |
| 2004/0162207 | A1 | * | 8/2004 | Ruf | B31B 1/06 493/309 |
| 2005/0137072 | A1 | | 6/2005 | Jackson | |
| 2008/0067221 | A1 | | 3/2008 | Mengistu et al. | |
| 2009/0247380 | A1 | * | 10/2009 | Monti | B31B 1/80 493/315 |
| 2010/0204030 | A1 | * | 8/2010 | Pazdernik | 493/123 |
| 2012/0100977 | A1 | | 4/2012 | Graham et al. | |

FOREIGN PATENT DOCUMENTS

| | | |
|---|---|---|
| AU | 200154060 | 1/2002 |
| ES | 2142189 | 4/2000 |
| GB | 1073985 | 6/1967 |

* cited by examiner

*Primary Examiner* — Gloria R Weeks

*Assistant Examiner* — Tanzim Imam

(74) *Attorney, Agent, or Firm* — Thompson Hine LLP

(57) ABSTRACT

A machine for automated construction of a bulk bin includes an erecting and construction station, a collapsed body blank supply station and a bottom blank supply station. A body bank pick mechanism picks a collapsed body blank from the collapsed body blank supply station and moves the collapsed body blank into the erecting and constructing station. A body blank opening assembly at the erecting and constructing station opens the collapsed body blank and forms an opened body blank. A bottom blank pick mechanism picks a bottom blank from the bottom blank supply station. A conveying device moves the bottom blank to the erecting and constructing station and beneath the opened body blank. A bottom blank fixing system applies the bottom blank to the opened body blank with flaps of the bottom blank secured to side walls of the opened body blank to produce an open bulk bin structure.

13 Claims, 17 Drawing Sheets

BULK BIN FORMER APPARATUS AND METHOD

TECHNICAL FIELD

The present application relates generally to the field of automated formation of bulk bins and, more specifically, to a machine and method to automatically construct and erect a bulk bin from a collapsed body blank and a bottom blank.

BACKGROUND

Bulk bins, which are a kind of heavy-duty paperboard container, are usually used to contain meat or other product as to which an ordinary box/case lacks sufficient strength. Because of its special function, the paperboard of bulk bin is thicker and also heavier than typical paperboard, and the formation of the bulk bin is therefore more difficult.

Known bulk bin forming methods in general are manual or semi-automatic. One attempt can be found in U.S. Pat. No. 5,624,368, in which a folded bulk bin was opened with the aid of a simple machine. Another attempt was found in U.S. Pat. No. 7,681,781, which introduced a manual way to open and seal the bottom of the bulk bin. The common problem of all such attempts are, they are not fully automatic to open the main wall and seal the bottom wall of the bulk bin with the main wall and therefore, obviously, it takes longer time and manpower to make a bulk bin. The productivity of such forming methods way is not high.

In another attempt, an automatic machine under U.S. Pat. No. 7,381,176 is made to form a collapsible bulk bin. The machine picks up the side of the collapsed main wall and glues the bottom wall with the flaps of the collapsed main wall. This machine is designed to form a collapsible bulk bin, in other words, the completed bulk bin is not a fully formed ready to pack type bin. When this type of bulk bin needs to be used, workers need to open it from a collapsible condition. In addition, the method shown in the patent consists of several separate machines working together and therefore, it needs more factory space to install the whole set of machines which is not an economy of space.

It would be desirable to provide a bulk bin forming system and method that is fully automated and erects and constructs the bulk bin at a single station from a collapsed body blank and a bottom blank.

SUMMARY

In one aspect, a fully automated method of forming a ready to use bulk bin involves the steps of: providing an erecting and constructing station; providing a collapsed body blank supply station adjacent the erecting and constructing station; providing a bottom blank supply station adjacent the erecting constructing station; moving a collapsed body blank from the collapsed body blank supply station to the erecting and constructing station, the collapsed body blank including multiple side walls that interconnect at fold lines; opening the collapsed body blank at the erecting and constructing station to provide an opened body blank; moving a bottom blank from the bottom blank supply station to the erecting and constructing station, the bottom blank including a main body and multiple flaps; applying glue to the flaps as the bottom blank is moved from the bottom blank supply station to the erecting and constructing station; aligning the bottom blank with the opened body blank; and engaging the bottom blank onto an end of the opened body blank such that the flaps of the bottom blank are folded into position alongside walls of the opened bottom blank and secured thereto.

In another aspect, a method of forming a ready to use bulk bin involves the steps of: providing an erecting and constructing station; providing a collapsed body blank supply station adjacent a first side of the erecting and constructing station; providing a bottom blank supply station adjacent a second side of the erecting constructing station; picking a collapsed body blank from the collapsed body blank supply station and moving it to the erecting and constructing station, the collapsed body blank including multiple side walls that interconnect at fold lines; opening the collapsed body blank at the erecting and constructing station to provide an opened body blank; picking a bottom blank from the bottom blank supply station and moving it to the erecting and constructing station, the bottom blank including a main body and multiple flaps; aligning the bottom blank with the opened body blank, the multiple flaps of the bottom blank having glue thereon; moving a body blank support head into an open first end of the opened body blank and toward the bottom blank at a second end of the opened body blank; engaging the bottom blank onto the second end of the opened body blank such that the flaps of the bottom blank are folded into position along side walls of the opened body blank such that the flaps are pressed against the side walls while the body blank support head is positioned to maintain position of the side walls during the pressing operation; and disengaging the flaps when the flaps are sufficiently adhered to the side walls and moving the body blank support head outward of the first end to produce an open bulk bin structure that can be unloaded from the erecting and constructing station for use.

In still a further aspect, a machine for automated construction of a ready to use bulk bin includes an erecting and construction station, a collapsed body blank supply station alongside the erecting and constructing station and a bottom blank supply station alongside the erecting and constructing station. A body bank pick mechanism is configured to pick a collapsed body blank from the collapsed body blank supply station and move the collapsed body blank into the erecting and constructing station. A body blank opening assembly at the erecting and constructing station is configured for opening the collapsed body blank and forming an opened body blank. A bottom blank pick mechanism is configured to pick a bottom blank from the bottom blank supply station. A conveying device is positioned to move the bottom blank to the erecting and constructing station and beneath the opened body blank. A bottom blank fixing system is configured to apply the bottom blank to the opened body blank with flaps of the bottom blank secured to side walls of the opened body blank to produce an open bulk bin structure.

By way of example, a typical bulk bin may have a height in the range of 20 inches to 60 inches, a length dimension in the range of 39 inches to 48 inches and a width dimension in the range of 23 inches to 40 inches.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 15 shows body blank support head device;

DETAILED DESCRIPTION

Figure 1:
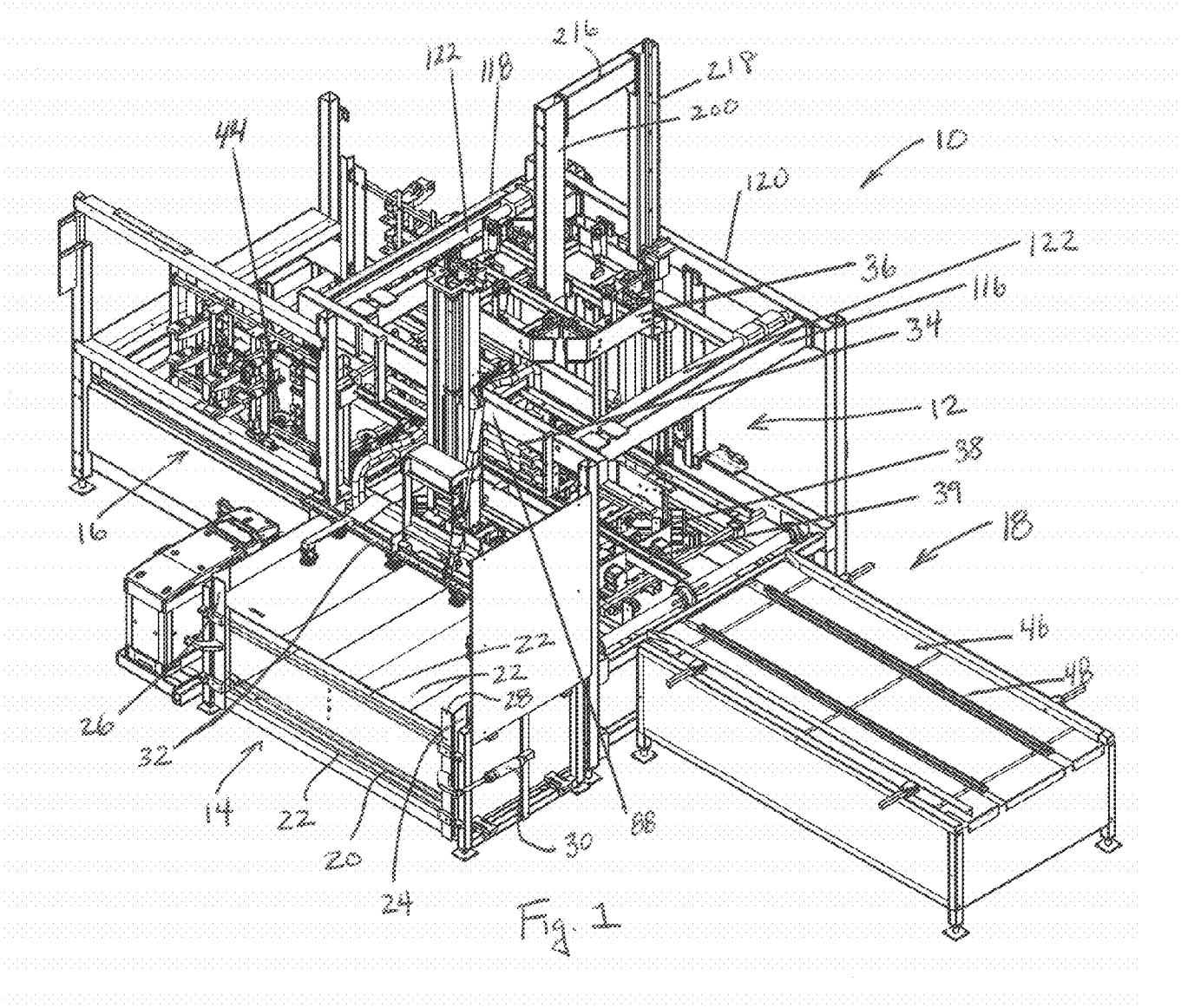
FIG. 1 shows a perspective view of a multi-station bulk bin forming machine.

Referring to FIG. 1, a perspective view of an automated bulk bin forming machine 10 is provided. The machine 10 includes an erecting and constructing station 12, a collapsed body blank supply station 14, a bottom bank supply station 16 and an outfeed station 18. Each of stations 14, 16 and 18 is positioned adjacent a respective side of the erecting constructing station 12. In the illustrated embodiment, stations 16 and 18 are at opposed sides of station 12, and station 14 is offset from each of stations 16 and 18 by ninety degrees.

The collapsed body blank supply station 14 includes a stack 20 of generally horizontally arranged collapsed body blanks 22. As used herein, the terminology "generally horizontally arranged" when referring to blanks means that the blanks are arranged with opposed major faces offset from vertical by no more than ten degrees. In the illustrated embodiment the blanks 22 include eight side walls joined to each other along fold lines as will be shown in more detail below, but other configurations are possible. The stack 20 may be disposed within a station frame 24 that keeps the stack in desired alignment and position. Exterior end panels 26, 28 of the frame may be pivoted outwardly away from the stack (e.g., via an actuator 30) to create an access opening for loading of additional collapsed body blanks. A body blank picking mechanism 32 is provided at station 14 for selecting individual collapsed body blanks 22 and moving them to the erecting and constructing station 12.

The erecting and constructing station 12 includes a blank opening assembly 34 and a body blank support head mechanism 36. The blank opening assembly 34 opens the blank beneath the support head 36, and the support head 36 moves down into the opened body blank during construction. Station 12 also includes a bottom plank push up device 38 that is used to engage the bottom blank with the opened body blank as will be described in further detail below. The station 12 also includes bin conveyor or pusher mechanism 39 for moving completed bins out of station 12 and onto the outfeed station 18.

Figure 2:
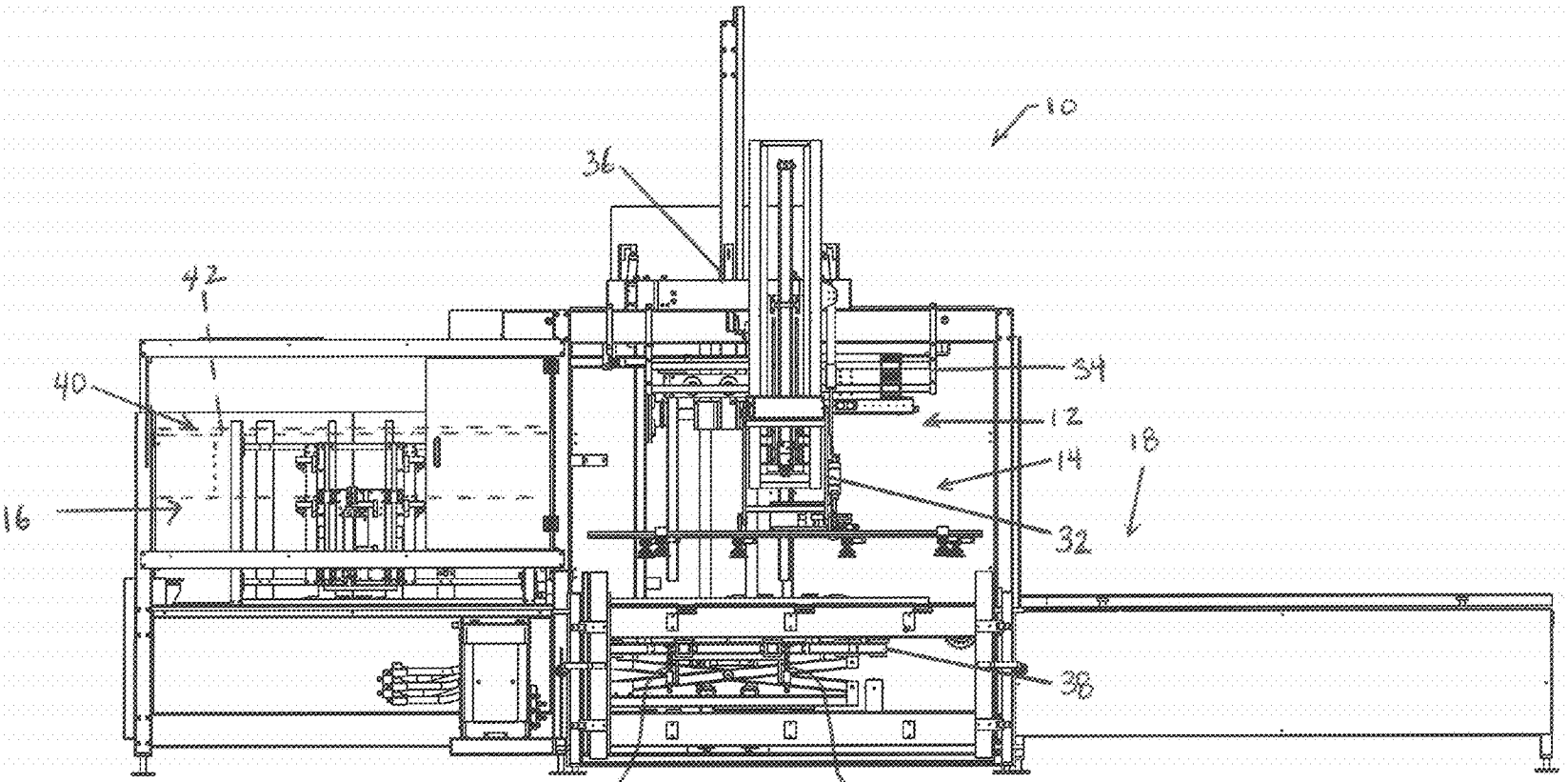
FIG. 2. shows a side elevation view of the machine of FIG. 1.

The bottom blank supply station 16 includes a stack 40 of generally horizontally arranged bottom blanks 42 (shown only schematically in FIG. 2). Suitable frame structure for supporting the stack is provided. A bottom blank pick mechanism 44 is positioned for pulling a single blank from the bottom of the stack and moving it to the erecting and constructing station 12 for application to the opened body blank.

The outfeed station 18 includes a surface 46 for supporting the bins and may also include conveyance mechanisms 48 for moving the bins. However, it is contemplated that in certain embodiments the outfeed station 18 may be nothing more than an accessible location at which a machine operator picks the bin from the station 12 as it exits station 12.

The above device provides an advantageous method of bulk bin formation as follows. Once the device is fully set up with appropriate blank stacks 20 and 40, the machine is put into a run mode that provides full automation of the process.

Figure 3:
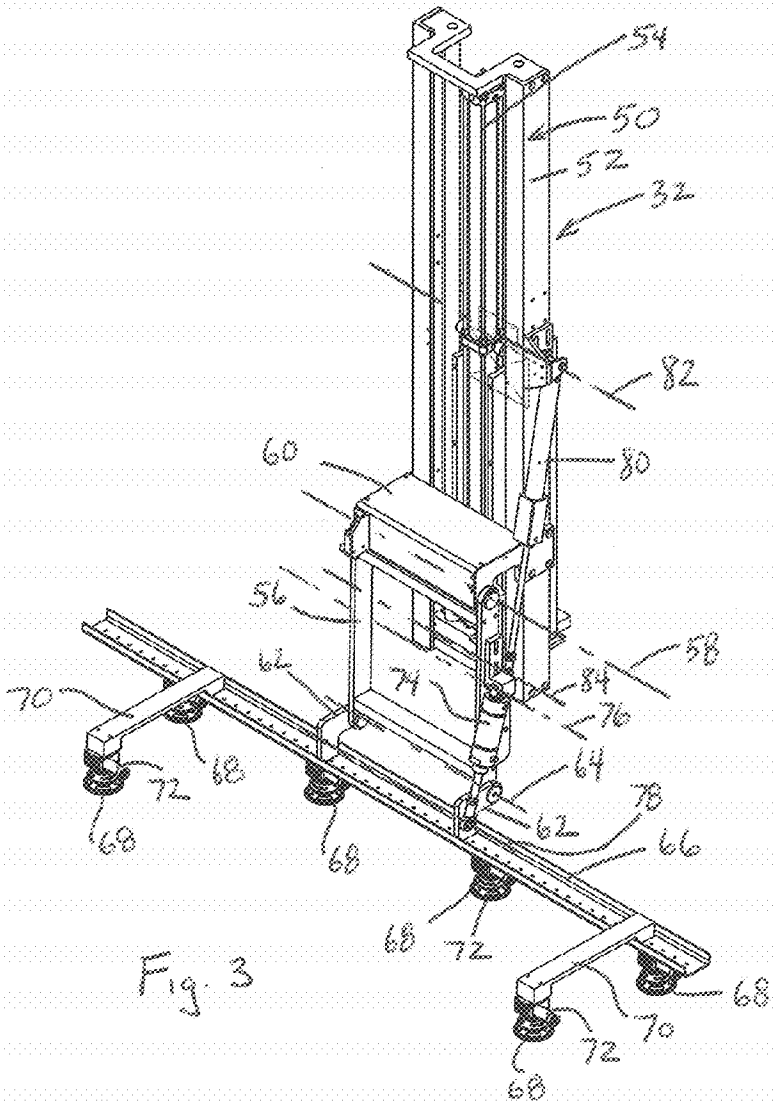
FIG. 3 shows an isolated perspective view of a body blank pick mechanism.

As an initial step, a collapsed body blank 22 is picked from the collapsed body blank supply station 14 and moved to the erecting and constructing station 12. In this regard, and referring to FIG. 3, an exemplary body blank pick mechanism 32 is shown in isolation. The mechanism includes an upright stanchion 50, which in the illustrated embodiment is formed by a U-shaped frame 52 mounted for vertical movement up and down along a center mast 54, which is fixed to a frame of the machine. The mechanism 32 further includes a swing frame 56 pivotally mounted (e.g., about pivot axis 58) to a side bracket 60 that is fixed to the stanchion frame 52. L-brackets 62 are pivotally mounted (e.g., about pivot axis 64) at opposed sides of the lower end of the swing frame 56. The brackets 62 are fixed to a long bar 66 having a plurality of suction cups 68 mounted thereto. Spaced apart arms 70 extend from the long bar 66 and include respective suction cups 68 as well. Each suction cup 68 includes a connection 72 for tubing that will enable a suction to be pulled for purpose of picking in holding blanks. Each side of the swing frame 56 is also connected to the distal end of one of the L-brackets via a pneumatic cylinder mechanism 74, with one end of the pneumatic cylinder mechanism pivotally mounted to the swing frame (e.g., about pivot axis 76) and the other end of the pneumatic cylinder mechanism pivotally mounted to the bracket (e.g., about pivot axis 78). Each side of the stanchion frame 52 is also connected to a respective side of the swing frame 56 via a pneumatic cylinder mechanism 80, with one end of the pneumatic cylinder mechanism 80 pivotally mounted to the stanchion frame (e.g., about pivot axis 82) and the other end of the pneumatic cylinder mechanism 80 pivotally mounted to the swing frame (e.g., about pivot axis 84). The pneumatic cylinders 74 and 80 are shown in their respective extended conditions in FIG. 3.

Figure 4:
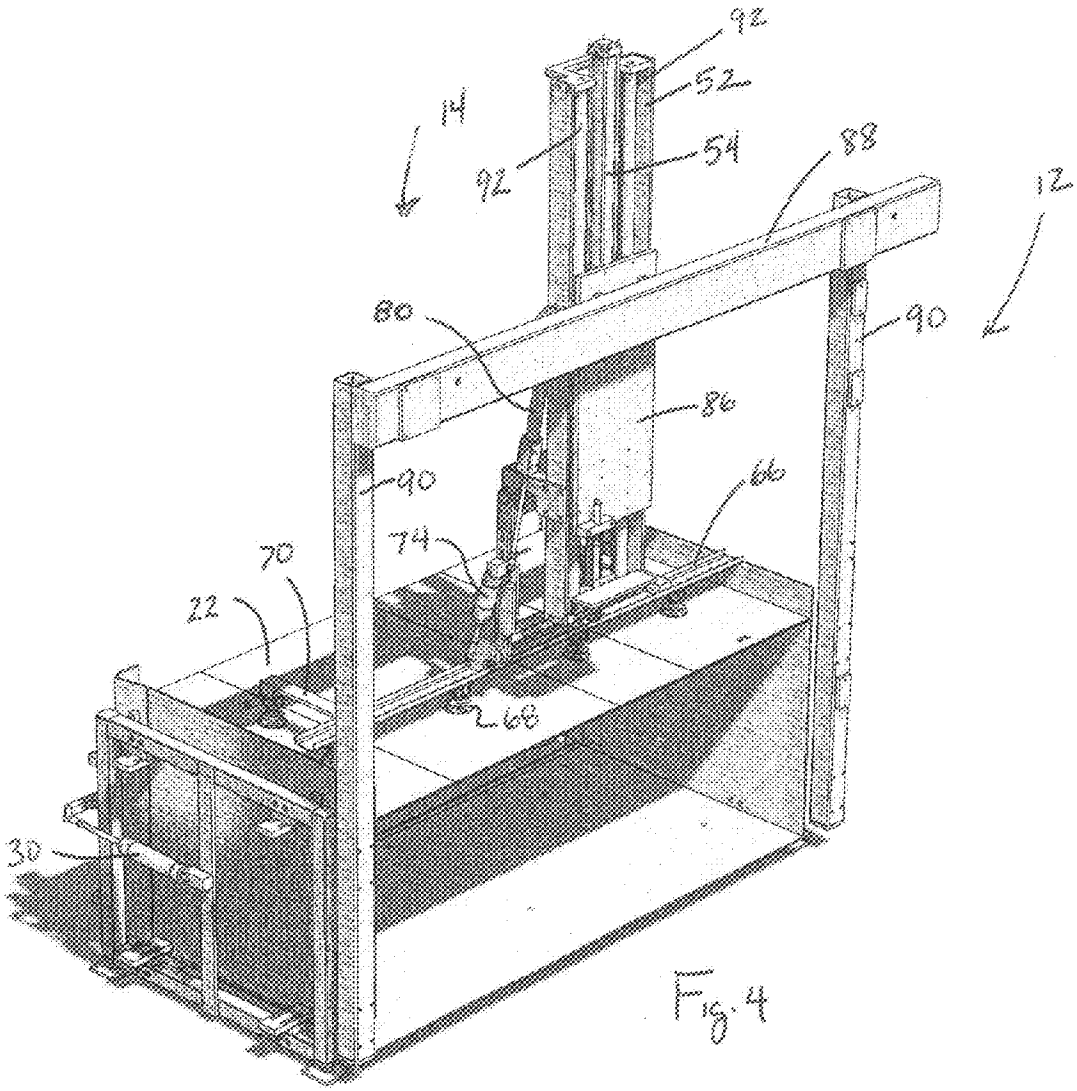
FIG. 4 shows the mechanism of FIG. 3 at the point of initial pick.
Figure 5:
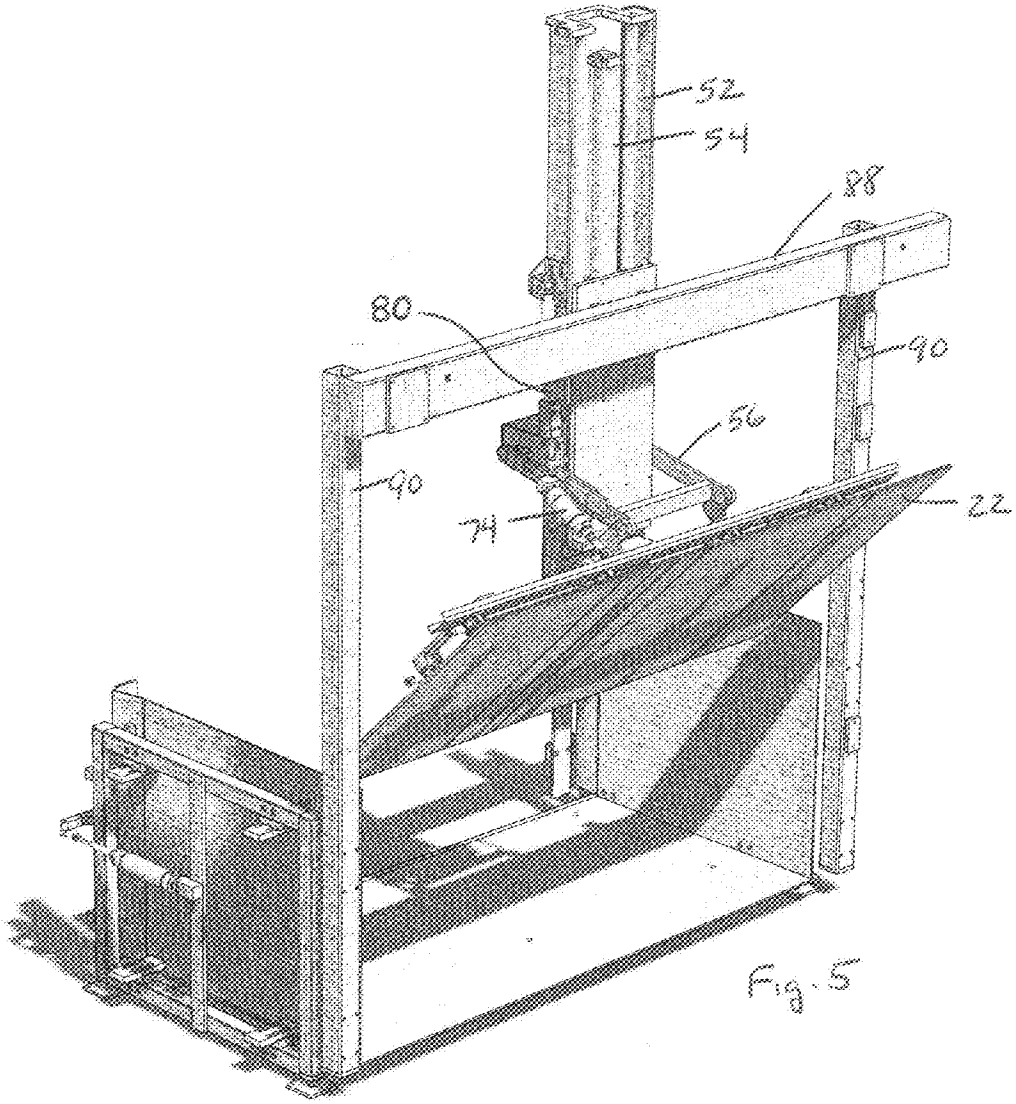
FIG. 5 shows the mechanism of FIG. 4 at an intermediate stage of collapsed body blank transfer.
Figure 6:
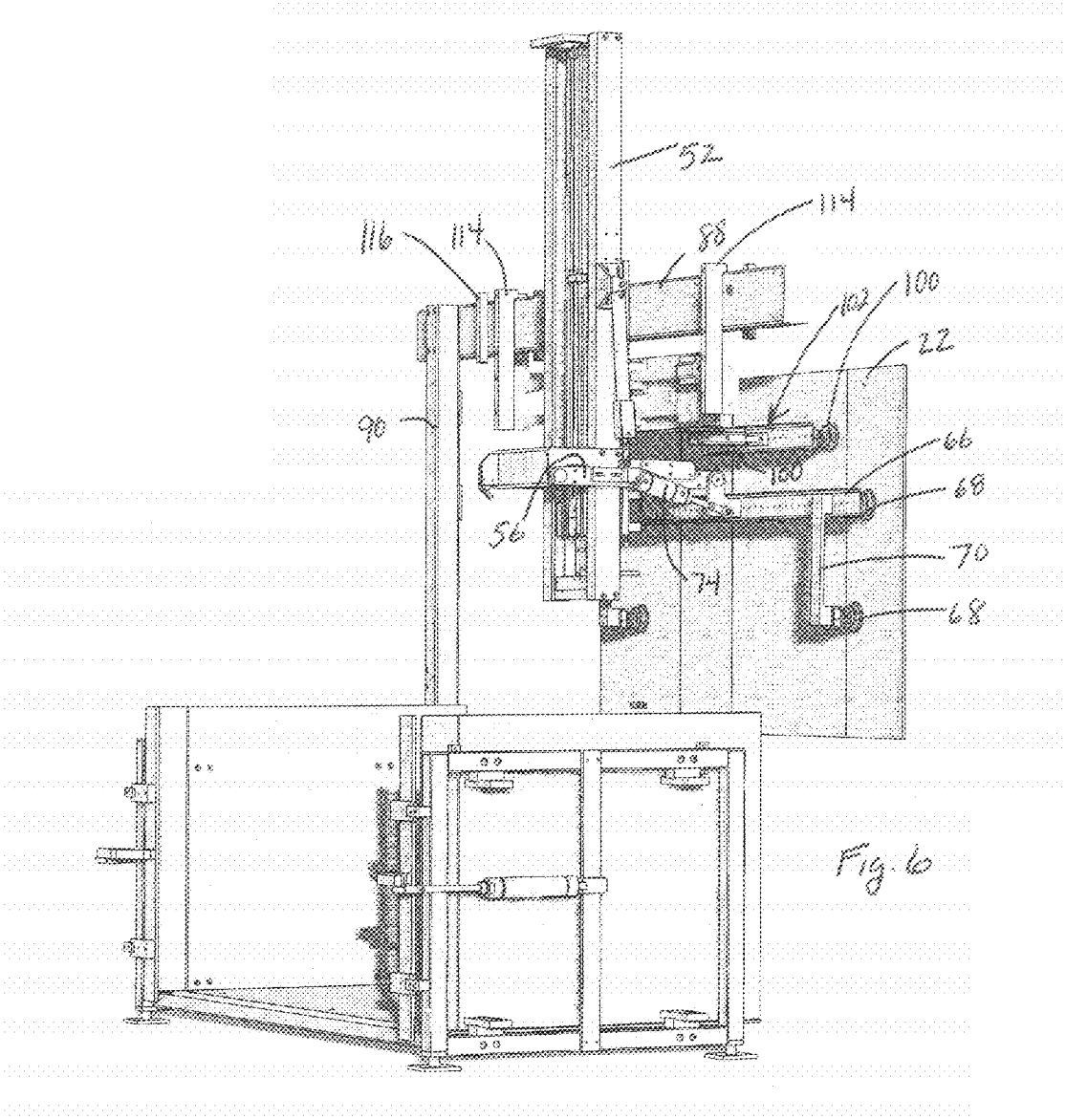
FIG. 6 shows the mechanism of FIG. 4 upon completion of transfer of the collapsed body blank.
Figure 7:
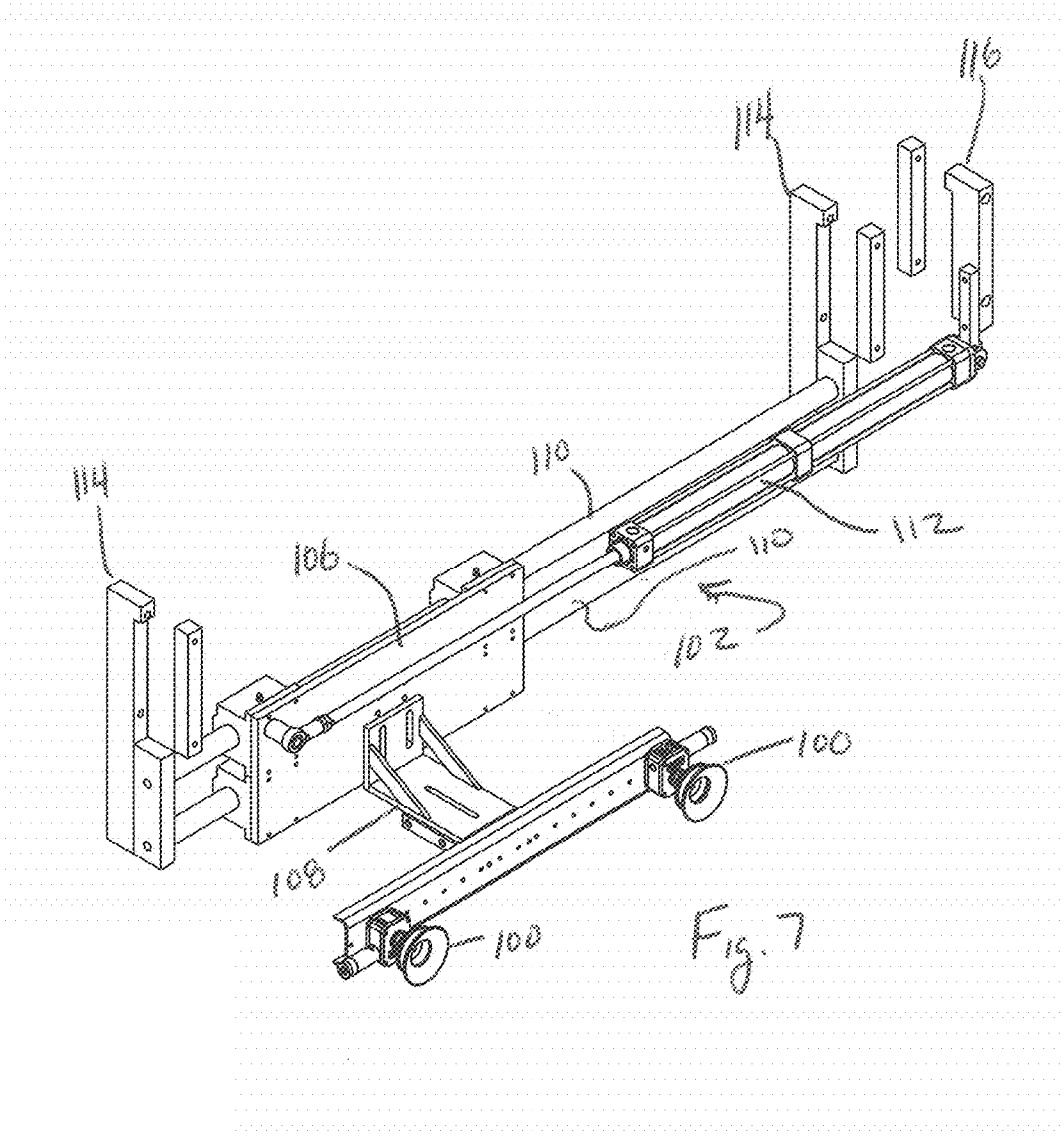
FIG. 7 shows one gripping part of a body blank opening mechanism.

As seen in FIG. 4, the center mast 54 of the picking mechanism is mounted via a plate 86 to a lateral beam 88 (e.g., supported by two vertical beams 90) at the side of the erecting and constructing station 12. By way of example, the center mast 54 may operate as a linear actuator that moves the stanchion frame 52 up and down relative to the plate 86 with slide rods 92 sliding in guides (not shown) on the other side of the plate 86. To pick a collapsed body blank 22 from the station 14, the stanchion frame 52 is moved downward with the pneumatic cylinders 74 and 80 in extended positions as shown, causing the suction cups 68 to engage the top of the blank. The vacuum/suction is engaged (if not already engaged at the time of contact) and the stanchion frame 52 moved back upward to pull the blank off of the stack. When the blank has been moved high enough (e.g., sufficiently clear of the remaining body blanks in the stack), the pneumatic cylinders are operated to retract, causing the swing frame 56 to pivot and move beneath the bottom of the stanchion frame 52 and then upward into a horizontal orientation (per FIG. 5). The pneumatic cylinders 74 may also be retracted to set the body blank 52 at an angle as the swing frame 56 pivots, and the final movement of the body blank to a vertical orientation (see FIG. 6) occurs when the pneumatic cylinders 74 are again extended. By the foregoing movement, the collapsed body blank is picked from a top of the body blank stack in its generally horizontal orientation and is reoriented to be in a generally vertical orientation at the erecting and constructing station 12.

Figure 8:
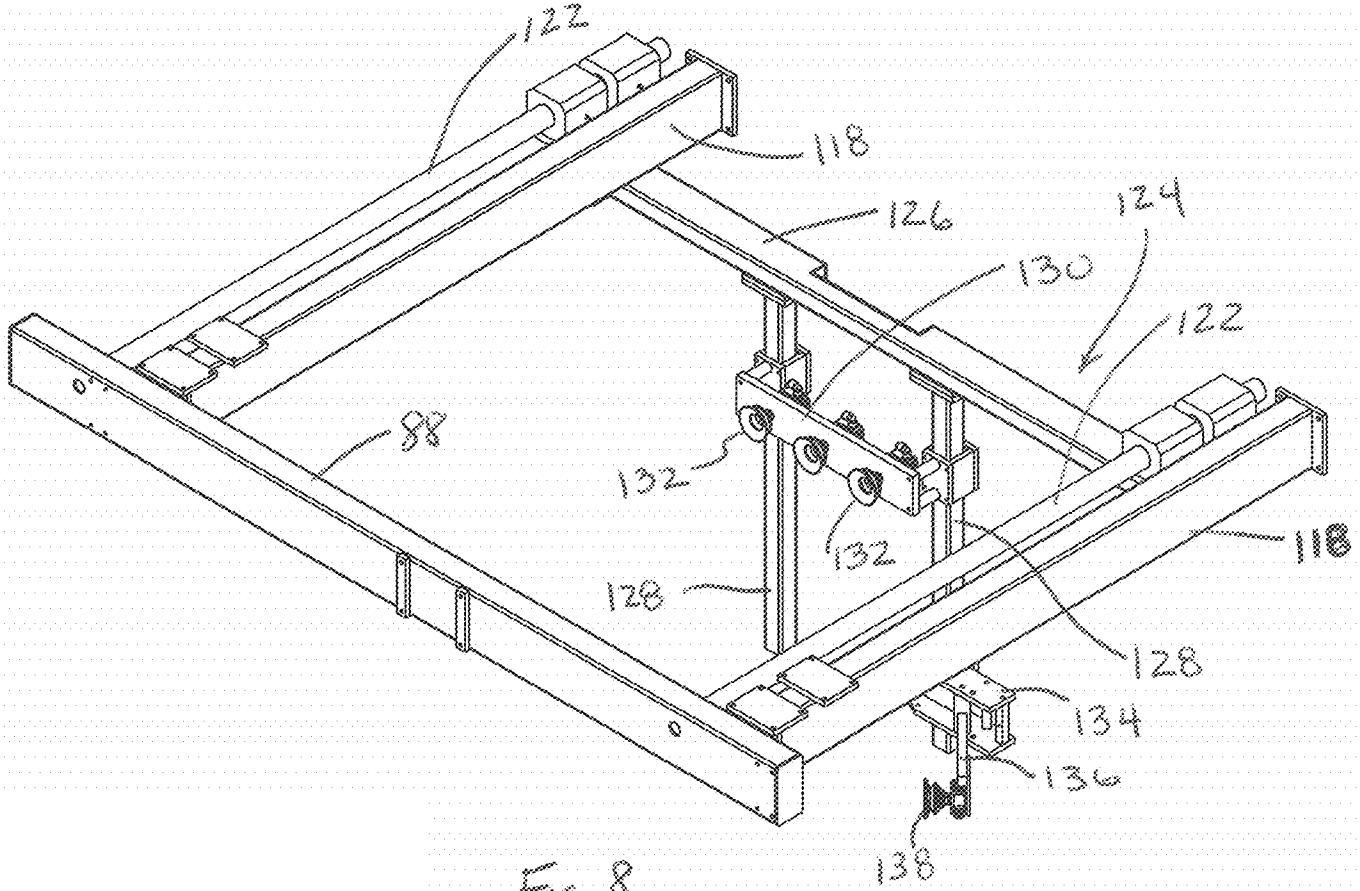
FIG. 8 shows another gripping part of the body blank opening mechanism.

When the pneumatic cylinders 74 are extended as part of the final move of the blank to vertical, the body blank is moved into contact with suction cups 100 of one gripping part 102 of the blank opening assembly 34. The suction cups 102 are mounted on a lateral bar 104, which in turn is mounted to a slide frame 106 via a bracket 108. The slide frame rides on slide rods 110 and is moved along the slide rods via a pneumatic cylinder mechanism 112. The slide rods are supported on the lateral beam 88 via lateral mount brackets 114 fixed to the ends of the rods. The end of the pneumatic cylinder mechanism 112 is also supported on the lateral beam 88 via a mount bracket 116. As seen in FIG. 8, spaced apart beams 118 extend perpendicularly from beam 88 and join another lateral beam 120 (see FIG. 1). Spaced apart slide rods 122 also extend between and are supported by lateral beams 88 and 120. Another gripping part 124 of the blank opening assembly slides along the slide rods 122 and is formed by a slide frame 126 having vertical rods 128 extending downwardly therefrom. The beams 118 are hollow and contain pneumatic cylinders linked to move the slide frame 126. A lateral plate 130 extends between the rods 128 and has suction cups 132 mounted thereon. A lower bracket 134 is mounted to one rod 128 and includes a pivotal arm 136 thereon, with a suction cup 138 at the moving end of the arm.

When the body blank is moved to vertical, the gripping part 124 is maintained in a spaced relation from the gripping part 102 to provide space for the body blank to move into position. Once the move to vertical is complete, the gripping part 124 is moved toward the gripping part 102 and into contact with the body blank 22 as per FIG. 9. Notable, the suction cups 100 of gripping part 102 and suction cups 132 and 138 of griping part 124 oppose each other and engage opposite side faces of the collapsed body blank in this orientation. Once the body blank 22 is fully engaged and held by the gripping parts 102 and 104, the pneumatic cylinder mechanism 74 (see FIG. 6) is again retracted to pull the suction cups 68 away from the body blank, thereby releasing the body blank from the picking mechanism 32 and completing the transfer to the body blank opening assembly 34. The picking mechanism can then begin a reverse movement back to the body blank stack in preparation for a next pick.

Figure 9:
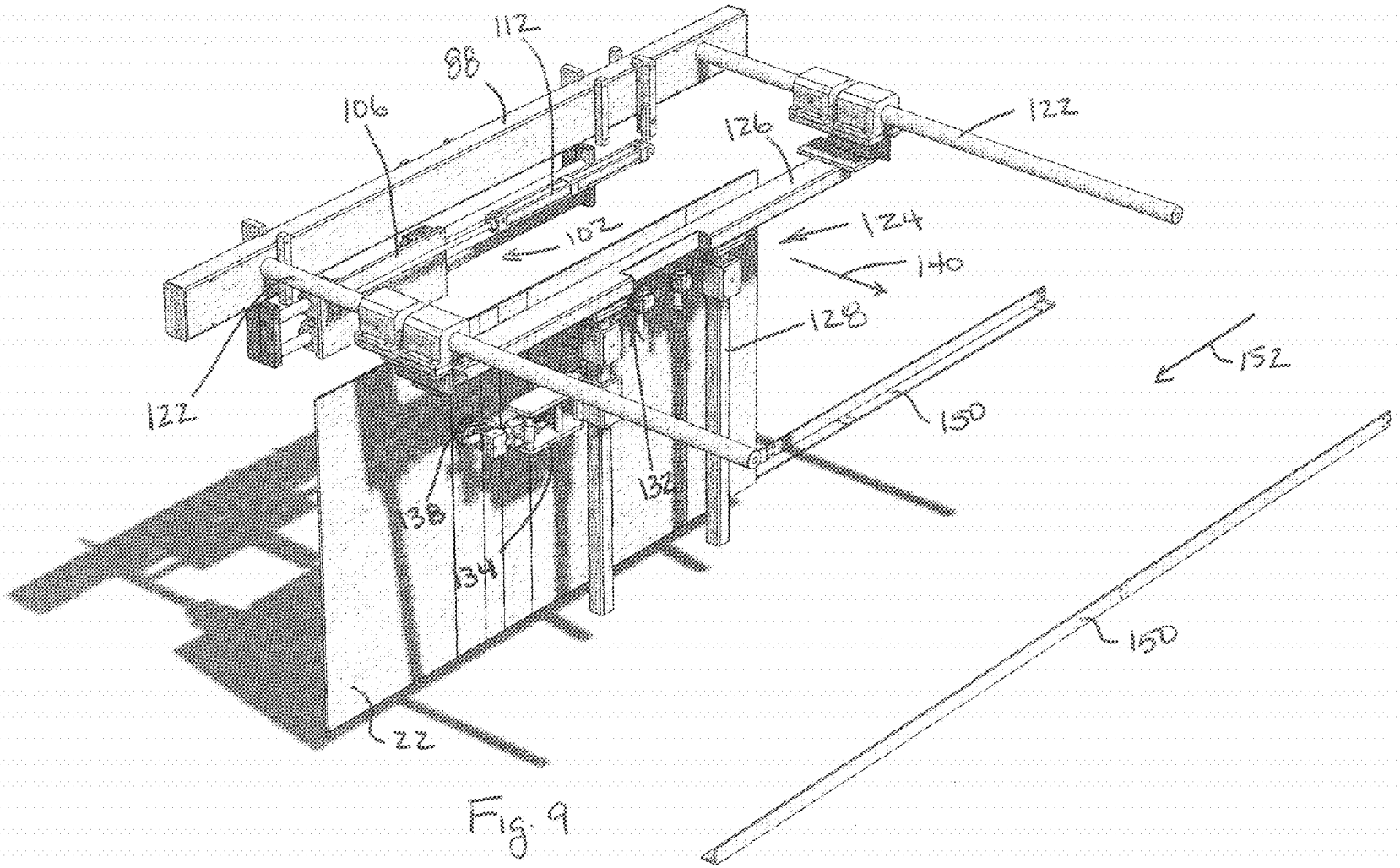
FIG. 9 shows the two gripping parts before opening begins.
Figure 10:
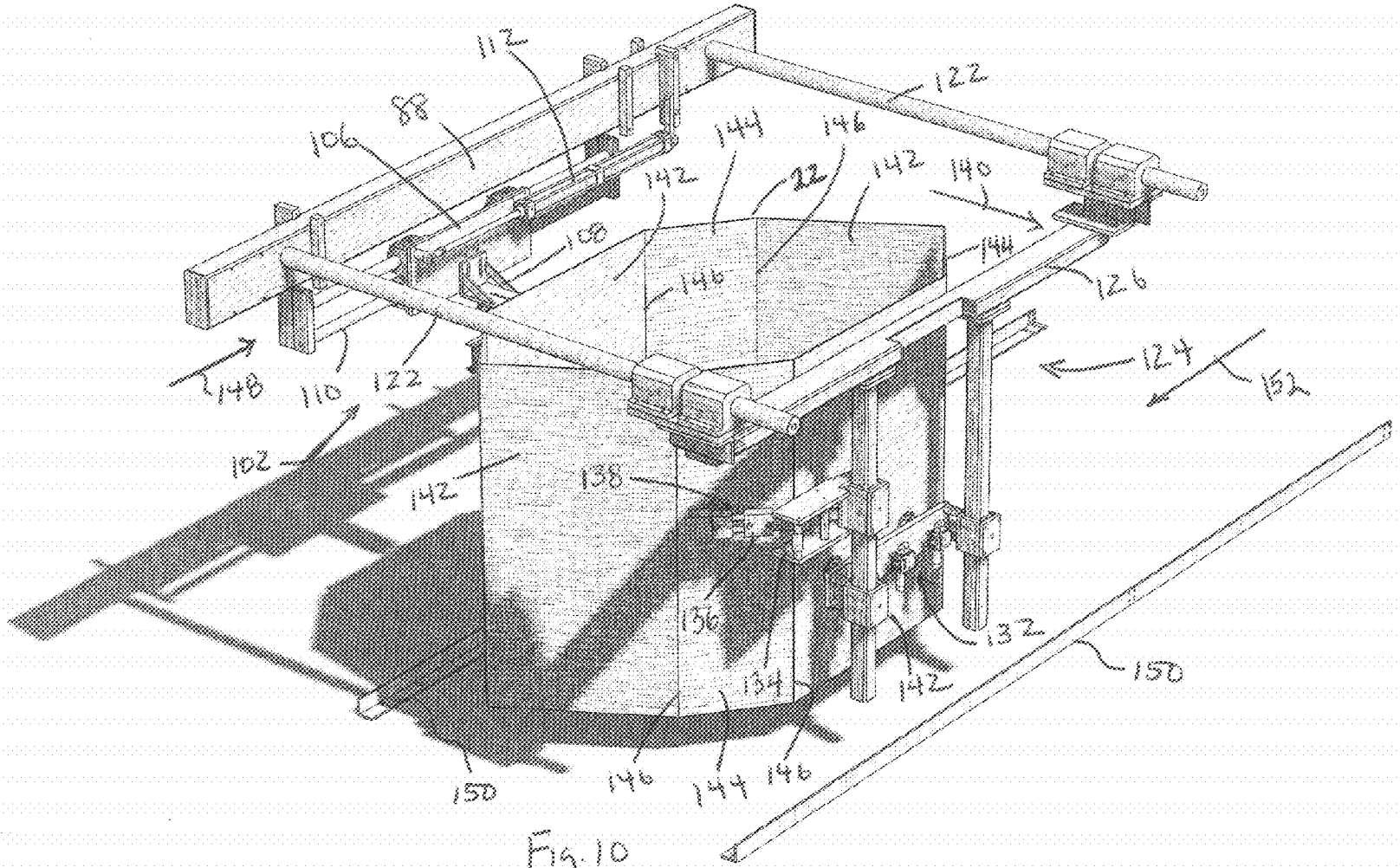
FIG. 10 shows the two gripping parts at an intermediate stage of opening of the body blank.

Once the pick mechanism 32 has released the body blank 22, the blank opening assembly 34 can begin the opening operation by moving the gripping part 124 away from gripping part 102 via sliding of the slide frame 126 along the rods 122 in the direction shown by arrow 140 in FIGS. 9 and 10. As shown, the body blank includes four major side walls 142 and four minor side walls 144, with fold lines 146 between the alternating sequence of major-minor-major sidewalls. The major side walls 142 may all be the same size or, as in the case of the illustrated embodiment, one set of opposed major side walls may be slightly larger than the other set of opposed major side walls. The suction cups 100 (not seen in FIGS. 9 and 10) of gripping part 102 engage a major side wall 142 and the suction cups 132 of the gripping part 124 engage an opposite major side wall 142 (e.g., the two aforementioned major side walls 142 are opposite each other in the opened condition of the body blank). The suction cup 138 of gripping part 124 engages a minor side wall 144. When the gripping part 124 is moved away from gripping part 102, the body blank begins to be pulled open. Roughly midway through the movement operation of the gripping part 124, the pneumatic cylinder mechanism 112 begins to retract and move the slide frame in the direction shown by arrow 148 in FIG. 10, where direction 148 is perpendicular to direction 140. This movement assures that the two major side walls 142 being gripped are moved into opposite positions across the body blank (i.e., because in the collapsed state of the body blank those two major side walls are offset from each other). The arm 136 and suction cup 138 pivot as the minor side wall 144 to which the suction cup 138 is engaged angles away from the major side wall 142 to which suction cups 132 are engaged. Also shown in FIGS. 9 and 10 are spaced apart bottom side rails 150 that serve as guides for the bottom blank (not shown) which will be fed in along direction 152.

Figure 11:
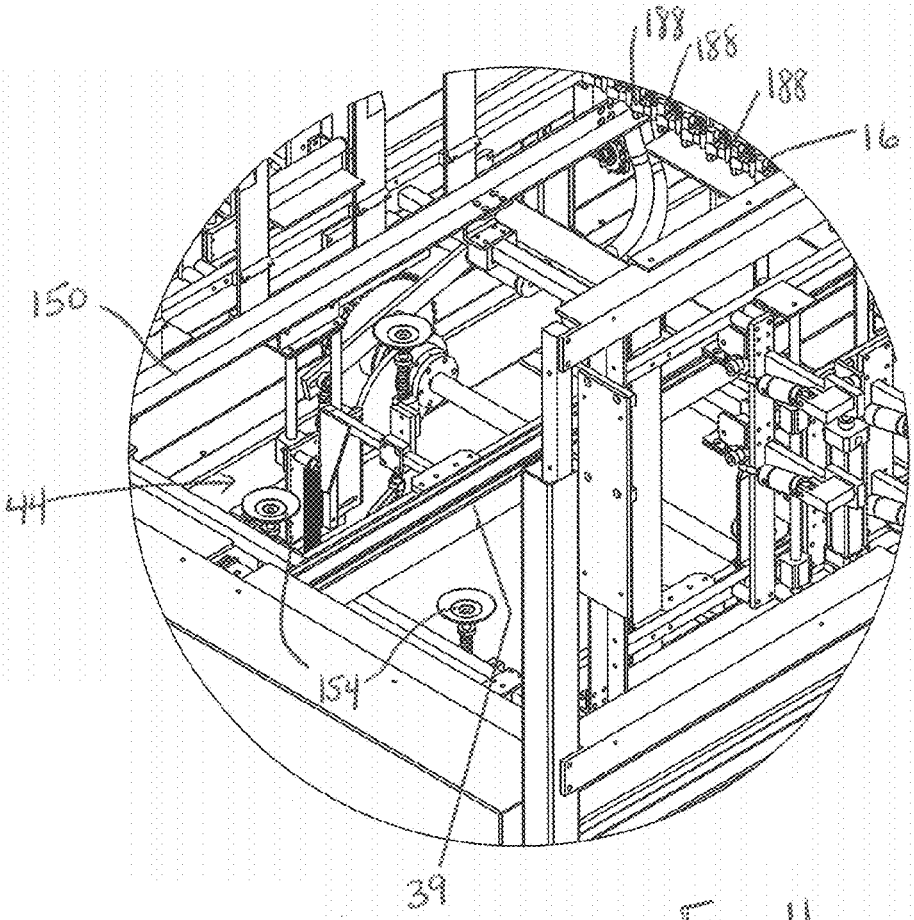
FIG. 11 shows a partial perspective view of the bottom blank supply station.
Figure 12:
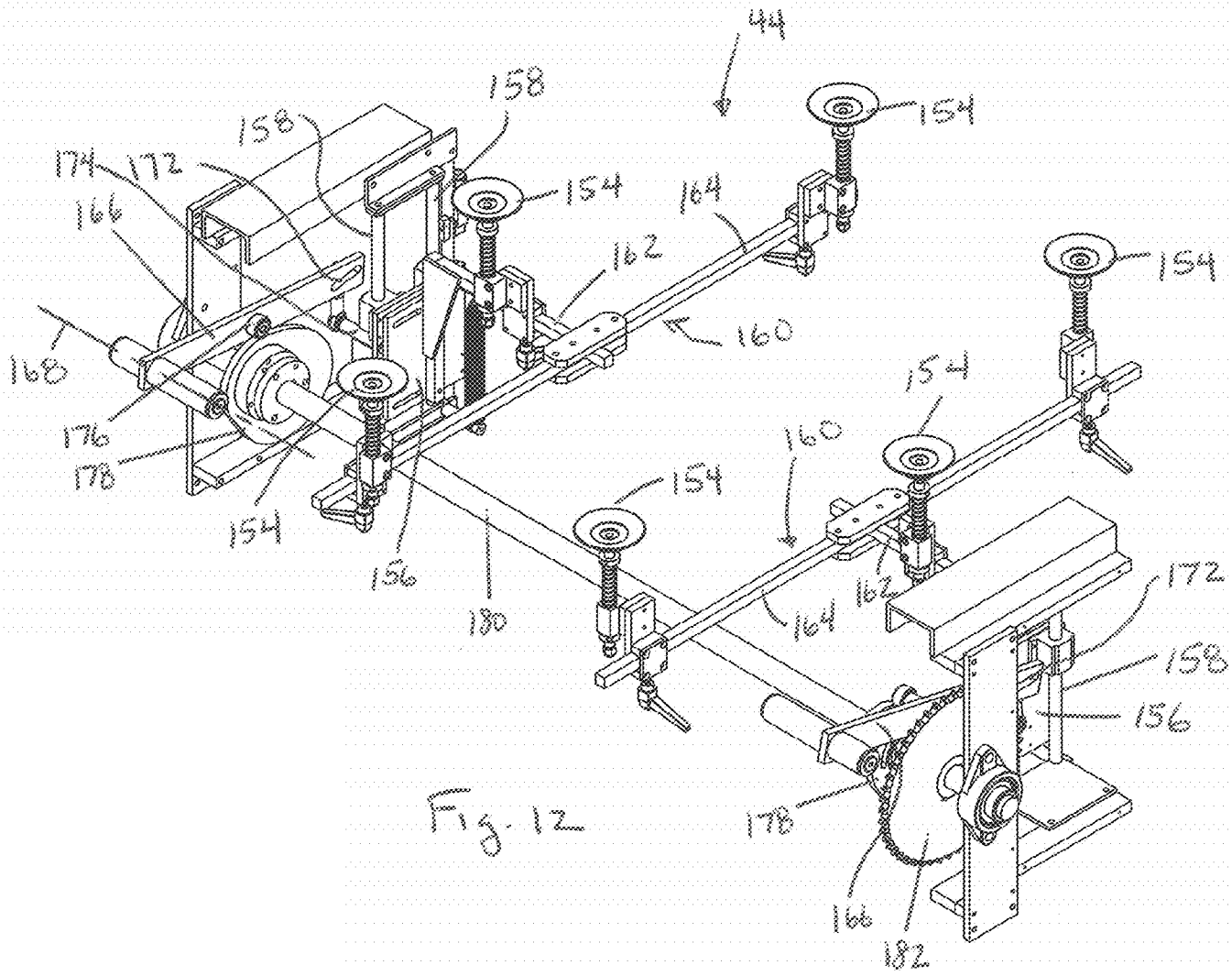
FIG. 12 shows an isolated perspective of the bottom blank pick mechanism.

In this regard, FIG. 11 shows a partial perspective of the bottom blank supply station 16 (no bottom blanks shown) and shows the ends of the side rails within the station 16. Also shown is the bottom blank pick mechanism 44 that includes multiple suction cups 154. As seen in the isolated perspective view of the mechanism 44 in FIG. 12, a pair of spaced apart slide plates 156 are each mounted for sliding movement along a respective set of spaced slide rods 158. Each slide plate includes a suction cup assembly 160 fixed thereto, each of which is made up of multiple rods 162 and 164 and suction cups 154. Lever arms 166 include one end mounted for pivot about a fixed pivot axis 168, and an opposite end connected to the slide plate 156 via a slot 172 that slidingly engages with a L-bar link 174. A roller 176 is disposed along the arm 166 and rides on the peripheral surface of an eccentric plate 178. The plates 178 are rotatably driven by a shaft 180 that is connected to a gear wheel 182, which in turn is driven by a chain (not shown). As the gear wheel 182 is rotated, the eccentric plates 178 also rotate causing the lever arms 166 to pivot upward and then downward, likewise causing the slide plates 156 and associated suction cup assemblies 160 to move up and down. Such movement enables the mechanism to pick a bottom blank 42 from the bottom of the stack 40, as better seen with reference to FIG. 13. The stack 40 may, for example, be supported by short flanges on the side frames 184 that make up part of a bottom blank feeder 186. When the pick mechanism 44 is moved upward the suction cups 154 engage and grip the bottom surface of the bottom blank at the bottom of the stack 40. When the pick mechanism subsequently moves downward, the gripped bottom blank is pulled downward away from the stack 40 so that it is separated from the stack 40 and can be conveyed to the erecting and constructing station 12 along path/direction 152. In this regard, reference is again made to FIG. 11 that shows a far end of pusher rail mechanism 39 that extends from station 16 all the way through station 12. The rail mechanism 39 includes pushers movable along a slot of the rail, such that the pushers can engage an edge of the bottom blank resting atop the rail 39 and move the bottom blank to the station 12. The top surface of the rail 39 is generally coplanar with the horizontal surface of each of the side rails 150 for supporting the bottom blank during its movement.

Figure 13:
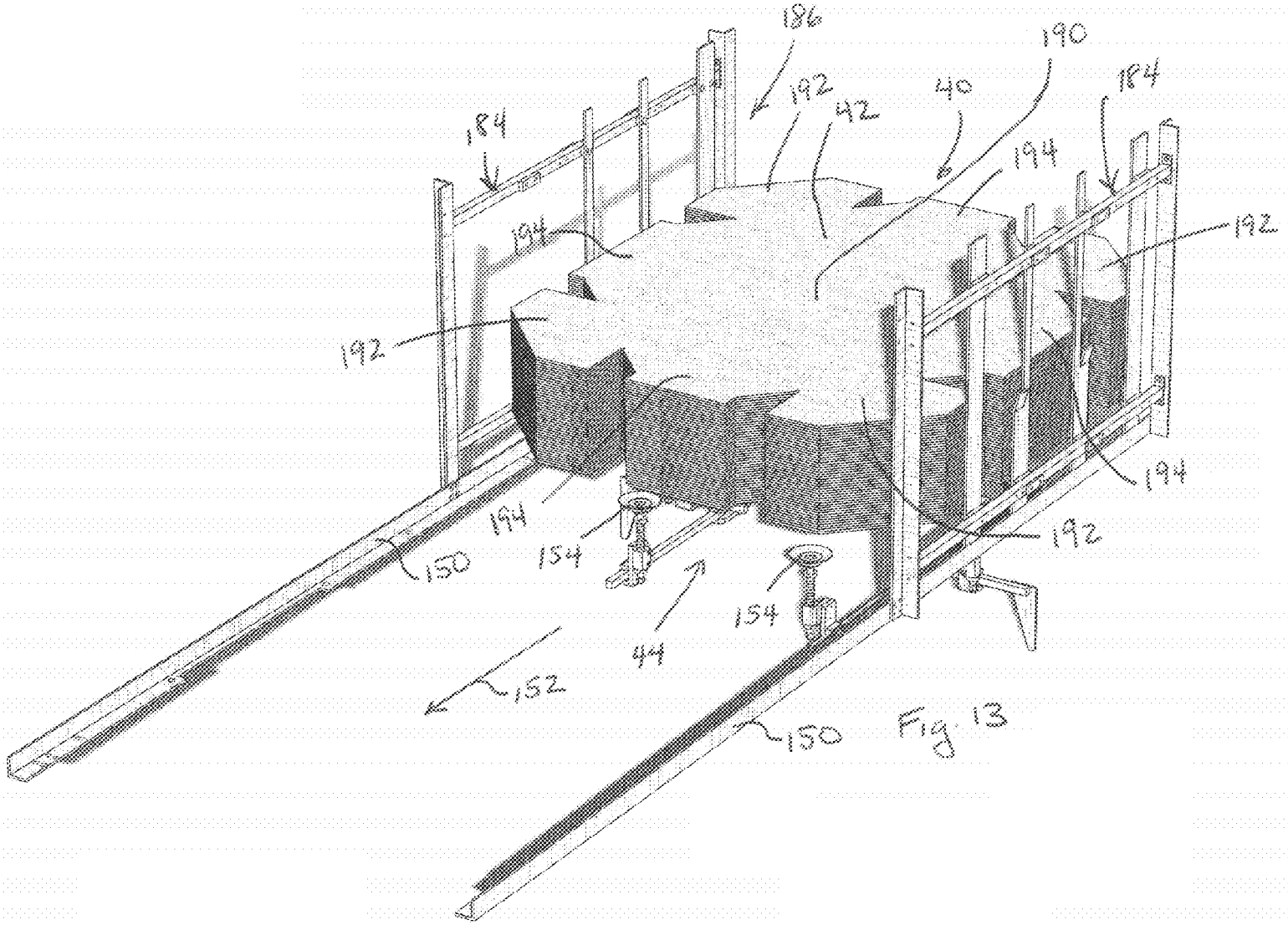
FIG. 13 shows a stack of bottom blanks.

As shown in FIG. 13, each bottom blank 42 includes a central, main body portion 190 with four peripheral minor flaps 192 and four peripheral major flaps 194. A line of downwardly directed glue ejection nozzles 188 (FIG. 11) is positioned between the bottom blank supply station 16 and the erecting and constructing station 12. As the bottom blank 42 is moved to the station, the nozzles are controlled to apply adhesive to the major flaps 194 and minor flaps 192 of the bottom blank. Accordingly, upon arrival of the bottom blank 42 into position below the opened body blank, per FIG. 14, the bottom blank is ready to be secured to the opened body blank 22. For this purpose, both a body blank support head mechanism 36 and a bottom blank push up device 38 are provided at the station 12.

Figure 14:
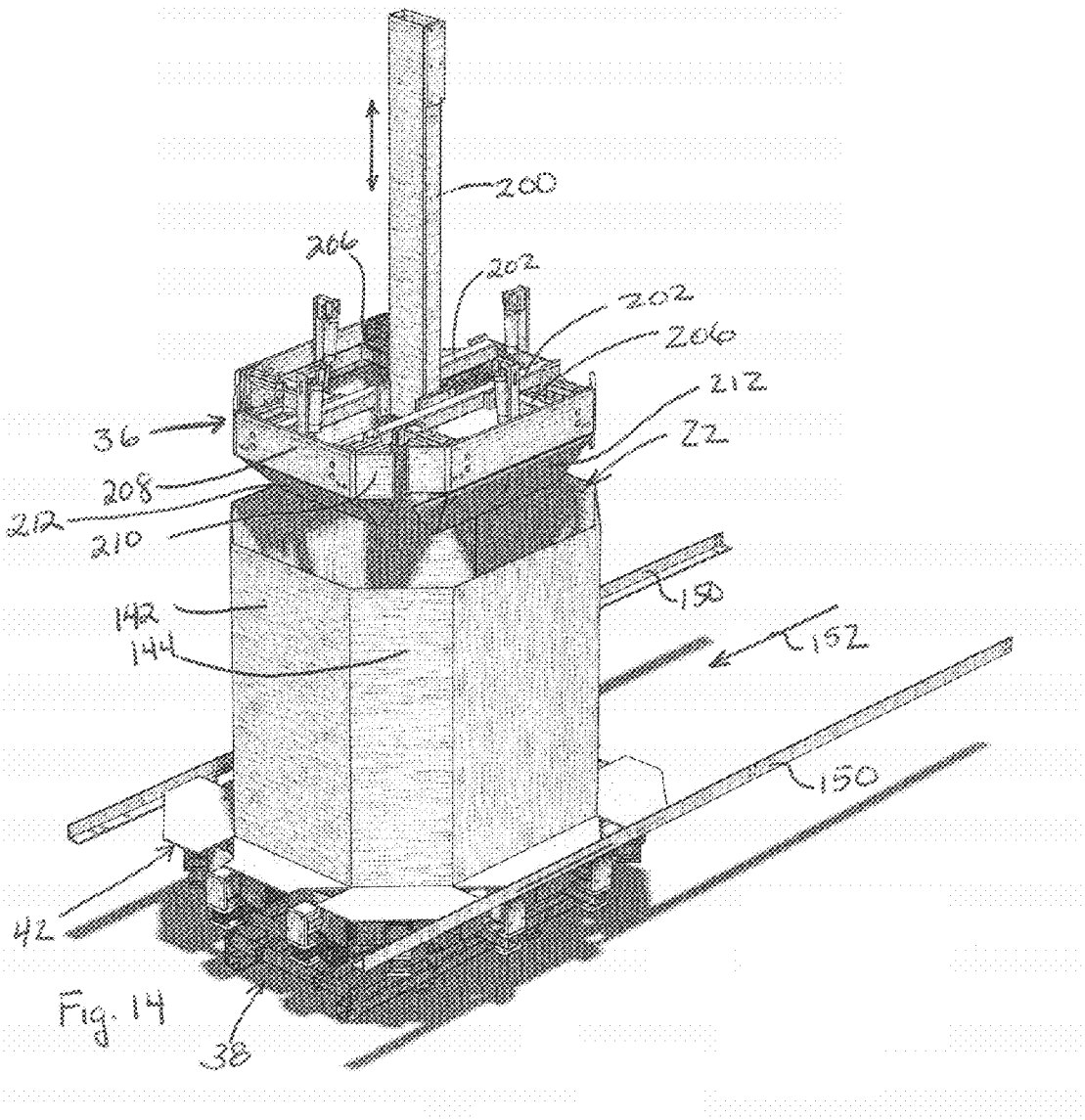
FIG. 14 shows a bottom blank aligned with an opened body blank.

Referring to FIGS. 14 and 15, the support head mechanism 36 includes an upright beam 200 having lateral beams 202 fixed at the bottom thereof on opposite sides of the beam 200. At each end of the set of beams 202, a wedge shaped vertical plate 204 is provided. Spaced apart side beams 206 extend from each beam 202 and also support wedge shaped vertical plates 204. Each wedge shaped plate 204 includes major wall portion 208 flanked by angled minor wall portions 210. Pivotal flap members 212 are connected to each wedge shaped plate 204 for movement between a raised horizontal position (e.g., per FIG. 15) and a lowered down position (e.g., per FIG. 14). A pneumatic cylinder mechanism 214 is provided for raising and lowering each flap member 212. In the lowered position of FIG. 15, the flap members 212 act to guide the head into the opening at the top end of the opened body blank. As seen in FIG. 1, the upper end of the vertical beam 200 is connected by a lateral beam 216 to a spaced apart vertical slide beam 218 that is mounted to ride up and down on a rail member that extends vertically alongside the location of the opened body blank. Once the head member has been moved down into the opened body blank 22, its progression continues to the bottom of the opened body blank and the flaps are pulled back upward to horizontal. The bottom blank can then be engaged onto the opened body blank 22.

Figure 16:
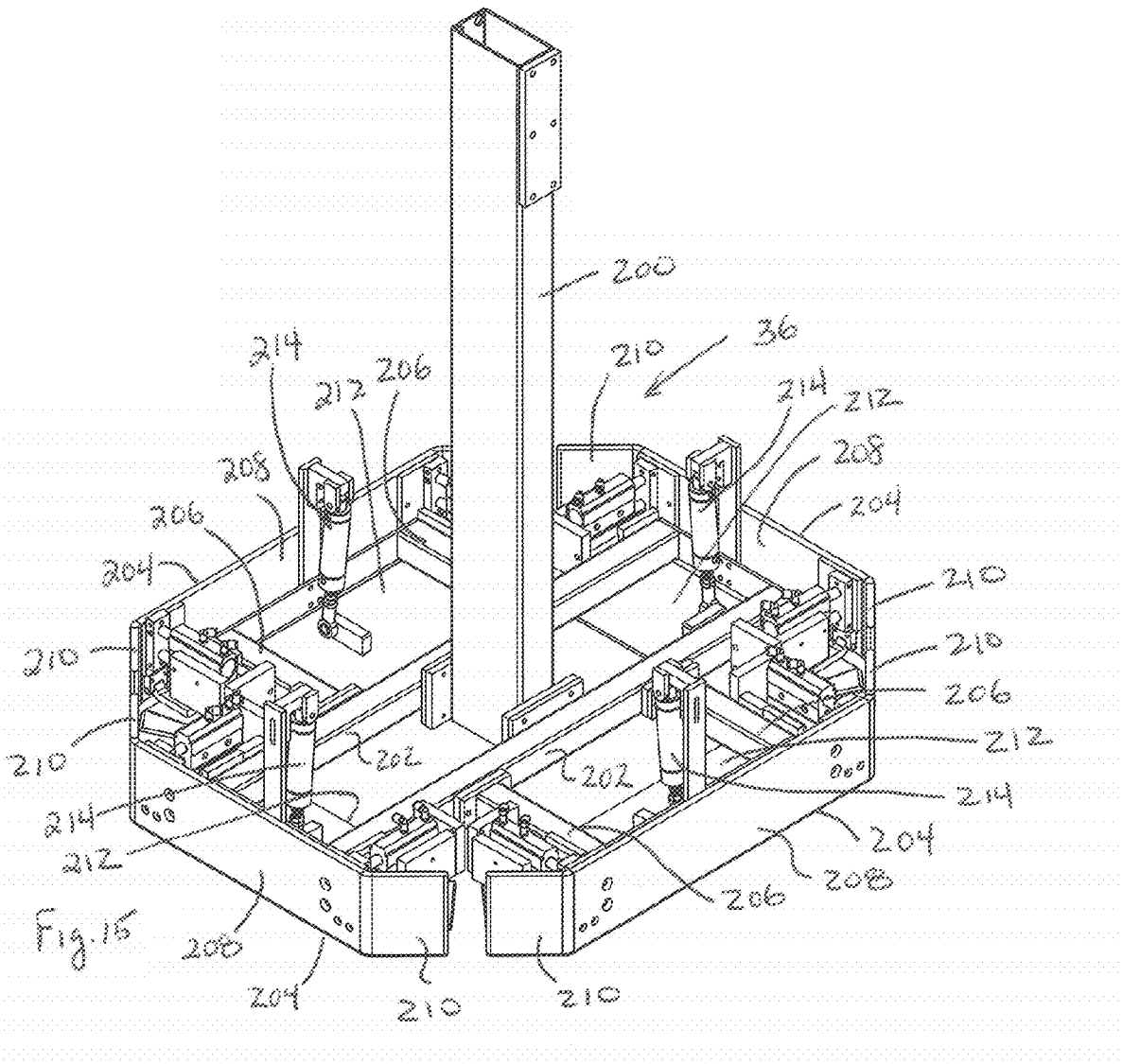
FIG. 16 shows a bottom blank push up device.
Figure 16:
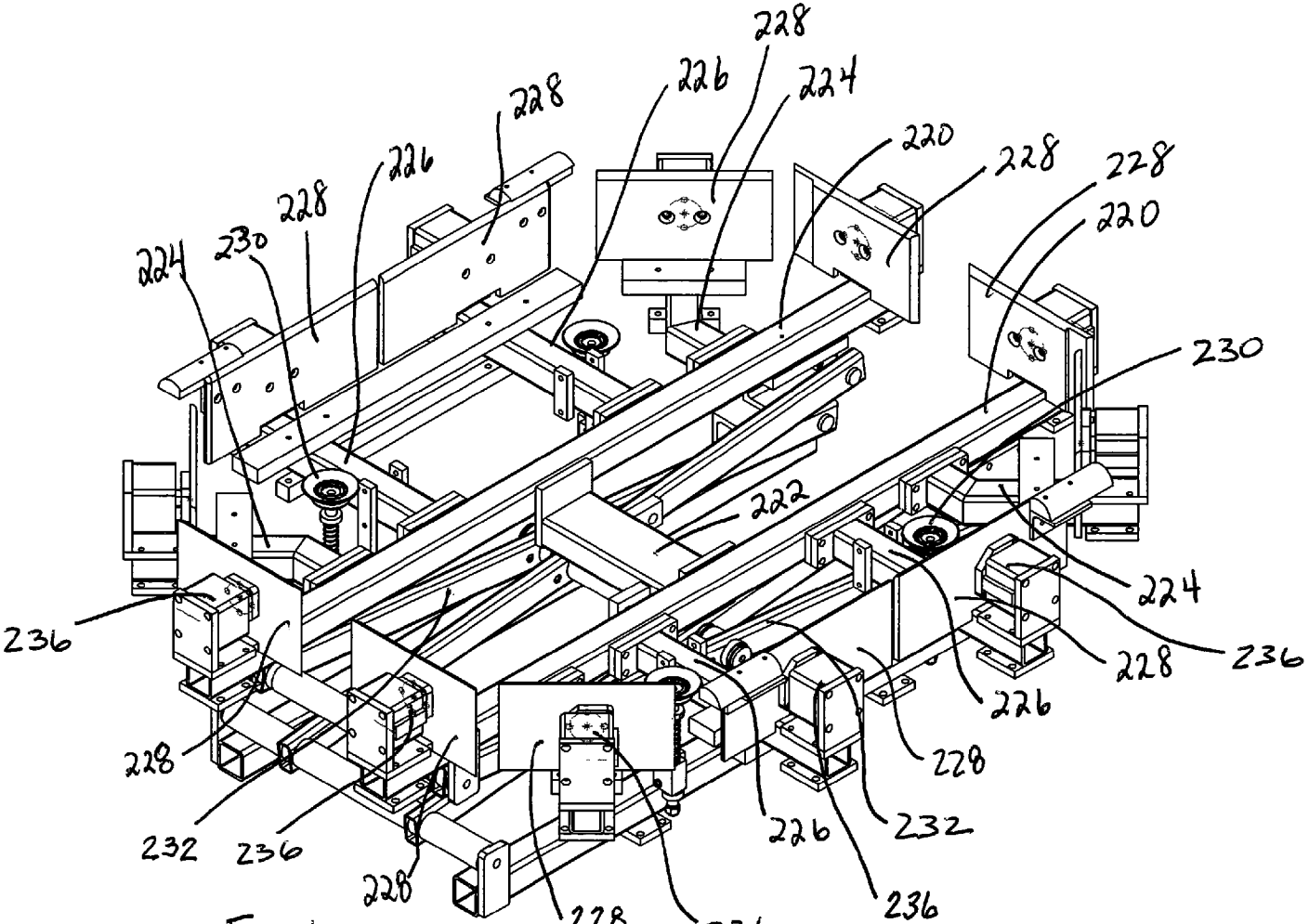
Figure 17:
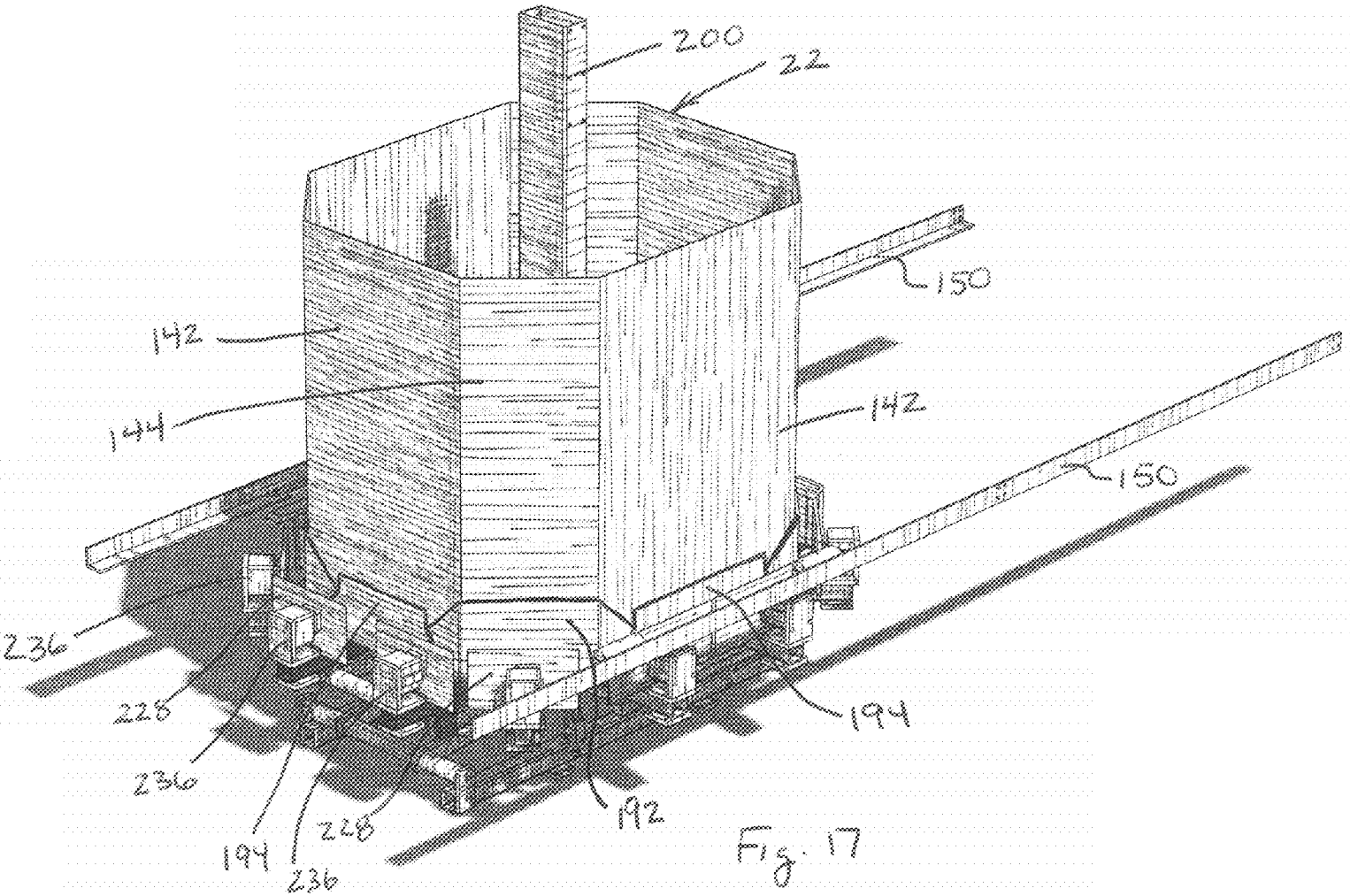
FIG. 17 shows the position of the body blank support head and bottom blank push up device at the final stage of bin formation.

Referring to FIG. 16, the bottom blank push up device 38 includes a pair of spaced apart beams 220 connected by a shorter center beam 222. Each beam 220 includes an angled beam member 224 located toward each end and extending away from the beam 220, and a pair of intermediate straight beam members 226 therebetween, also extending away from the beam 220. Upright plates 228 are located at each end of each beam 220, at the end of each angled beam members 224 and at the end of each straight beam member 226. Suction cups 230 are also provided for holding the bottom blank in place during the process. The above beam, plate and suction cup arrangement is mounted to a scissor-type lift system formed by spaced apart scissor lifts 232, each of which is moved by a corresponding pair of pneumatic cylinder mechanisms 234 (shown in FIG. 2). In a lowered position of the push up device as shown in FIG. 14, the top edges of the plate members 228 are located below the bottom blank 42. The scissor-lift system is operated, the plated members etc. are moved upward alongside the side walls 142, 144 of the opened body blank. As the plates 228 move upward, they engage and fold the bottom blank flaps 192, 194 into position alongside the side walls 142, 144.

Each plate 228 is connected to an actuator 236 that can operate to move the plate 228 between a retracted position, which is outward away from the location of the opened body blank side walls, and an extended position which is inward toward the location of the opened body blank side walls. The plates are maintained in the retracted position when the plates are initially moved upward along the side walls 142, 144 for flap folding, and then the actuators 236 are operated to move the plates inward and push the flaps 192, 194 into firm contact with the side walls 144, 142. In this regard, the wall portions 208 and 210 of the head internal of the opened body blank are positioned adjacent the internal surfaces of the side walls 142 and 144 so that the flaps and side walls are effectively pressed between the plates 228 and the head member wall portions when the actuators 236 are operated. This pressing operation is maintained for a suitable time period (e.g., several seconds) to assure good adhesion between the flaps and the side walls by operation of the glue previously applied to the flaps. Once the actuators 236 are released the plates 228 move away from the completed bin container and the push up device 38 is moved back down so that the completed bin can be conveyed into the outfeed station 18.

By the foregoing machine, the method of forming a ready to use bulk bin involves the steps of providing an erecting and constructing station 12, a collapsed body blank supply station 14 adjacent a one side of the erecting and constructing station 12 and a bottom blank supply station 16 adjacent another side of the erecting constructing station 12. A collapsed body blank 22 is picked by mechanism 32 from the collapsed body blank supply station 14 and moved to the erecting and constructing station 12. The collapsed body blank 22 includes multiple side walls 142, 144 that interconnect at fold lines 146. The collapsed body blank 22 is opened at the erecting and constructing station 12 to provide an opened body blank. A bottom blank 42 is picked by mechanism 44 from the bottom blank supply station 16 and moved to the erecting and constructing station 12. The bottom blank 42 includes a main body 190 and multiple flaps 192, 194. The bottom blank 42 is aligned with the opened body blank 22 (e.g., per FIG. 14), with the multiple flaps 192, 194 of the bottom blank having glue thereon. A body blank support head 36 is moved into an open end of the opened body blank 22 and toward the bottom blank at an opposite end of the opened body blank 22. The bottom blank is then engaged onto the opposite end of the opened body blank such that the flaps 192, 194 of the bottom blank are folded into positions along the side walls 144, 142 of the opened body blank, and the flaps 144, 142 are pressed against the side walls while the body blank support head is positioned to maintain position of the side walls during the pressing operation. The pressing of the flaps is stopped when the flaps are sufficiently adhered to the side walls, and the body blank support head is moved outward of the end of the body blank to produce an open bulk bin structure that can be unloaded from the erecting and constructing station for use.

The body portion 190 of the bottom blank 42 is configured to hold the open bulk bin structure against collapse of the side walls. Thus, the resulting bin is maintained in an open condition for use.

In the station 14, collapsed body blanks are arranged generally horizontally in a body blank stack 20. The collapsed body blank 22 is picked from a top of the body blank stack 20 in a generally horizontal orientation and is reoriented to be in a generally vertical orientation (per FIGS. 4-6) at the erecting and constructing station 12. At the station 16, bottom blanks are arranged generally horizontally in a bottom blank stack 40. The bottom blank 42 is picked from a bottom of the bottom blank stack 40 in a generally horizontal orientation and remains in a generally horizontal orientation once moved to the erecting and constructing station 12.

Glue is applied to the flaps 192, 194 of the bottom blank 42 as the bottom blank is moved from the bottom blank supply station 16 to the erecting and constructing station 12.

A body blank pick mechanism 32 moves vertically upward from the body blank stack 20 and then pivots the blank toward the erecting and constructing station in order to reorient the collapsed body blank to the generally vertical orientation. The body blank pick mechanism 32 transfers the collapsed body blank to a blank opening assembly 34 at the erecting and constructing station 12. The blank opening assembly 34 includes a first body blank holding mechanism 102 and a second body blank holding mechanism 124 arranged parallel to each other. In the opening step the second body blank holding mechanism 124 moves in a direction 140 away from the first body blank holding mechanism 102, and the first body blank holding mechanism 102 moves in a direction 148 that is perpendicular to the direction 140.

The body blank holding mechanisms 102 and 124 hold the opened body blank while the body blank 22 while the 36 support head is moved downward into the top opening of the opened body blank. A blank push up device 38 at the erecting and constructing station 12 includes flap fold plates 228 that move upward to fold the flaps 192, 194 upward and then move inward to engage the flaps 192, 194 to the side walls of the opened body blank, completing the construction.

It is to be clearly understood that the above description is intended by way of illustration and example only, is not intended to be taken by way of limitation, and that other changes and modifications are possible. For example, while pneumatic cylinder mechanisms are primarily described for movement of various components, it is recognized that other linear actuators or movers could be used.

What is claimed is:

1. A method of forming a ready to use bulk bin, the method comprising the steps of:

utilizing an automated machine that includes an erecting and constructing station, a collapsed body blank supply station adjacent a first side of the erecting and constructing station and a bottom blank supply station adjacent a second side of the erecting and constructing station;

picking a collapsed body blank from the collapsed body blank supply station and moving it to the erecting and constructing station, the collapsed body blank including eight side walls that interconnect at fold lines;

opening the collapsed body blank at the erecting and constructing station to provide an opened body blank;

picking a bottom blank from the bottom blank supply station and moving it to the erecting and constructing station, the bottom blank including a main body and eight flaps;

aligning the bottom blank with the opened body blank at the erecting and constructing station, each of the eight flaps of the bottom blank having glue thereon;

moving a body blank support head into an open first end of the opened body blank at the erecting and constructing station and toward the bottom blank at a second end of the opened body blank;

engaging the bottom blank onto the second end of the opened body blank at the erecting and constructing station by engaging each of the eight flaps of the bottom blank into a folded position alongside a respective one of the eight side walls of the opened body blank such that each flap is pressed against its respective side wall while the body blank support head is positioned to maintain position of each of the side walls; and disengaging each flap when each flap is sufficiently adhered to its respective side wall and moving the body blank support head outward of the first end to produce an open bulk bin structure that can be unloaded from the erecting and constructing station for use.

2. The method of claim 1 wherein the body of the bottom blank is configured to hold the open bulk bin structure against collapse of the side walls.

3. The method of claim 1 wherein:

collapsed body blanks are arranged horizontally in a body blank stack at the collapsed body blank supply station;

the collapsed body blank is picked from a top of the body blank stack in a horizontal orientation and is reoriented to be in a vertical orientation at the erecting and constructing station;

bottom blanks are arranged horizontally in a bottom blank stack at the bottom blank supply station;

the bottom blank is picked from a bottom of the bottom blank stack in a horizontal orientation and remains in a horizontal orientation once moved to the erecting and constructing station.

4. The method of claim 3 wherein:

glue is applied to the flaps of the bottom blank as the bottom blank is moved from the bottom blank supply station to the erecting and constructing station.

5. The method of claim 4 wherein:

a body blank pick mechanism moves vertically upward from the body blank stack and then pivots toward the erecting and constructing station in order to reorient the collapsed body blank to the vertical orientation;

the body blank pick mechanism transfers the collapsed body blank to a blank opening assembly at the erecting and constructing station.

6. The method of claim 5 wherein:

the blank opening assembly includes a first body blank holding mechanism and a second body blank holding mechanism arranged parallel to each other;

in the opening step the second body blank holding mechanism moves in a first direction away from the first body blank holding mechanism and the first body blank holding mechanism moves in a second direction that is perpendicular to the first direction.

7. The method of claim 6 wherein the open first end is a top end, the first body blank holding mechanism and second body blank holding mechanism hold the opened body blank while the body blank support head is moved downward into the opened body blank.

8. The method of claim 7 wherein the second end is a bottom end, a blank push up device at the erecting and constructing station includes flap fold plates that move upward to fold the flaps upward and then inward to engage the flaps to the side walls of the opened body blank.

9. The method of claim 1 wherein the collapsed body blank supply station is offset from the bottom blank supply station by ninety degrees.

10. A fully automated method of forming a ready to use bulk bin, the method comprising the steps of:

utilizing an automated machine that includes an erecting and constructing station, a collapsed body blank supply station adjacent the erecting and constructing station and a bottom blank supply station adjacent the erecting and constructing station;

moving a collapsed body blank from the collapsed body blank supply station to the erecting and constructing station, the collapsed body blank including eight side walls that interconnect at fold lines;

opening the collapsed body blank at the erecting and constructing station to provide an opened body blank;

moving a bottom blank from the bottom blank supply station to the erecting and constructing station, the bottom blank including a main body and eight flaps;

applying glue to each of the flaps as the bottom blank is moved from the bottom blank supply station to the erecting and constructing station;

aligning the bottom blank with the opened body blank;

moving a body blank support head into an open first end of the opened body blank at the erecting and constructing station and toward the bottom blank at a second end of the opened body blank;

engaging the bottom blank onto the second end of the opened body blank such that each of the flaps of the bottom blank is folded into position alongside a respective one of the side walls of the opened body blank and secured thereto by the glue.

11. The method of claim 10 wherein:

collapsed body blanks are arranged horizontally in a body blank stack at the collapsed body blank supply station;

the collapsed body blank is picked from a top of the body blank stack in a horizontal orientation and is reoriented to be in a vertical orientation at the erecting and constructing station.

12. The method of claim 10 wherein:

a blank opening assembly includes a first body blank holding mechanism and a second body blank holding mechanism arranged parallel to each other;

in the opening step the second body blank holding mechanism moves in a first direction away from the first body blank holding mechanism and the first body blank holding mechanism moves in a second direction that is perpendicular to the first direction.

13. A method of forming a ready to use bulk bin, the method comprising the steps of:

utilizing an automated machine that includes an erecting and constructing station, a collapsed body blank supply station adjacent a first side of the erecting and constructing station and a bottom blank supply station adjacent a second side of the erecting and constructing station;

picking a collapsed body blank from the collapsed body blank supply station and moving it to the erecting and constructing station, the collapsed body blank including multiple side walls that interconnect at fold lines;

opening the collapsed body blank at the erecting and constructing station to provide an opened body blank;

picking a bottom blank from the bottom blank supply station and moving it to the erecting and constructing station, the bottom blank including a main body and multiple flaps;

aligning the bottom blank with the opened body blank, the multiple flaps of the bottom blank having glue thereon;

moving a body blank support head into an open first end of the opened body blank and toward the bottom blank at a second end of the opened body blank;

engaging the bottom blank onto the second end of the opened body blank by engaging each flap of the bottom blank into a folded position along an exterior face of a respective side wall of the opened body blank such that each flap is pressed against the exterior face of its respective side wall while the body blank support head is positioned to maintain position of the side walls;

disengaging the flaps when the flaps are sufficiently adhered to the side walls and moving the body blank support head outward of the first end to produce an open bulk bin structure, wherein the body of the bottom blank is configured to hold the open bulk bin structure against collapse of the side walls; and conveying the open bulk bin structure out of the erecting and constructing station.

* * * * *